United States Patent [19]

Mudgett

[11] 4,129,338

[45] Dec. 12, 1978

[54] CELLULOSIC INSULATION BLOWING MACHINE

[75] Inventor: Donald F. Mudgett, St. Marys, Ohio

[73] Assignee: U.S. Fiber Corporation, Delphos, Ohio

[21] Appl. No.: 821,693

[22] Filed: Aug. 4, 1977

[51] Int. Cl.[2] ..... B65D 83/06

[52] U.S. Cl. ..... 302/2 A; 222/193; 222/236; 222/564; 302/56; 366/307

[58] Field of Search ..... 366/306, 307; 302/2 A, 302/56; 222/193, 226, 236, 410, 564

[56] References Cited

U.S. PATENT DOCUMENTS

| | | | |
|---|---|---|---|
| 338,786 | 3/1886 | Robison | 366/307 |
| 1,107,015 | 8/1914 | Babcock et al. | 302/56 X |
| 1,410,246 | 3/1922 | Field | 302/56 X |
| 3,995,775 | 12/1976 | Birkmeier et al. | 222/193 |

FOREIGN PATENT DOCUMENTS

| | | | |
|---|---|---|---|
| 371396 | 9/1963 | Switzerland | 302/56 |

*Primary Examiner*—David A. Scherbel
*Attorney, Agent, or Firm*—Richard D. Emch

[57] ABSTRACT

A cellulosic insulation blowing machine comprised of a base having a circular and shaped floor plate at its upper end and a cylindrical hopper assembly which is detachably connected over the floor plate. The shaped floor plate includes a circular horizontal center section, an integral upstanding annular vertical section and an upper outwardly and upwardly sloped section. Within the floor plate area is an agitator rotated at relatively low rpm which includes plural shaped arms corresponding to the contour of the foor plate such that the arms travel generally parallel to the floor plate. The material discharge opening is located along the vertical wall section of the floor plate and is connnected to a blower. An anti-spin bar is supported from the hopper assembly and spaced slightly above the arms of the agitator such that when the hopper is connected in an operating position, the bar is disposed diametrically over the floor plate center section in front of the discharge opening.

14 Claims, 5 Drawing Figures

CELLULOSIC INSULATION BLOWING MACHINE

The invention relates to an improved cellulosic insulation blowing machine used, for example, to apply a particulate form of insulation product in buildings. More particularly, the invention includes an improved feed assembly for such a machine.

BACKGROUND OF THE INVENTION

A machine for blowing cellulosic insulation into buildings, attics, etc., is disclosed in U.S. Pat. No. 3,995,775. This machine includes a generally cylindrical base assembly and a detachable correspondingly cylindrical upper hopper assembly thereon. A side mounted blower receives a particulate cellulosic insulation and mixes it with air. The blower discharges the insulation through a hose to an area of a building, such as an attic floor space. The material is deposited as a layer of thermal insulation. The base assembly of the machine includes a horizontal floor member and a rotating agitator consisting of horizontal arms. The agitator is supported by a rotatable shaft extending through the central point of the floor member such that the agitator arms rotate in spaced relation above the floor. A discharge opening in the horizontal floor is located off the center of the base and is connected to the inlet of the blower by a box conduit. The upper hopper assembly receives the prepared particulate insulation material for blowing insulation into the building work area. Gravity feeds the material through the floor opening assisted by the agitator.

SUMMARY OF THE INVENTION

The present invention is adaptable to the insulation blowing machine just described and provides an improved feed of the insulation material to the blower assembly. More specifically, the present invention includes an anti-spin bar assembly in close proximity over the rotary agitator to assure a constant feed of the material. The anti-spin bar tends to prevent voids, bridging or clogging of the discharge opening to the blower. In this respect, the invention incorporates a feed device in the machine to better regulate the flow of insulation and assure a more even, steady flow to the blower.

One of the structural features of the invention is a stepped, shaped floor plate member including an annular vertical wall segment. The feed opening is provided in this vertical wall and connected by conduit means to the intake of the blower. The rotary agitator is comprised of similarly stepped, shaped arm means of an extent which generally parallels the contour of the floor plate such that the agitator rotates parallel to the floor and beneath the anti-spin bar. The anti-spin bar is a diametrically disposed elongated bar member that is suspended from the hopper and located on a diameter of the vertical annular wall that is opposite or in front of the insulation discharge opening.

The movement of the agitator between the stationary anti-spin bar and the shaped floor plate conditions the insulation to a desirable consistency for steady flow in feeding it through the vertical wall opening and into the blower. Bunching or bridging of the insulation in the bottom of the hopper of the machine is reduced and this produces a superior result in the rate of application of the material to the work site and the uniformity of the flow.

As will be apparent from the detailed description hereinafter of a preferred embodiment of the invention, several further advantages and modifications may occur to those skilled in the art.

DETAILED DESCRIPTION OF THE PREFERRED EMBODIMENT

Figure 1:
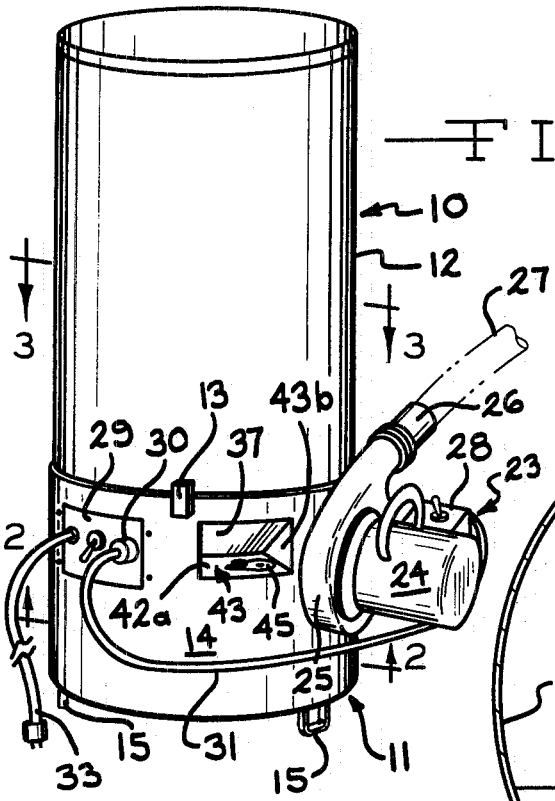
FIG. 1 is a perspective view of a cellulosic insulation blowing machine according to the present invention.

A cellulosic insulation blowing machine 10, according to the invention, is shown on FIG. 1. The machine 10 includes a cylindrical base assembly 11 and a detachable upper hopper 12 fastened by spaced-apart peripherally located snap assemblies, one of which appears on FIG. 1 at numeral 13. The snap assemblies are of conventional type having a catch or hook fastened on the side of hopper 12 and a cammed pulldown hasp fastened onto the side of the base 11 opposite the catch so that the hasp is engageable over the hook and a lever cam is pivoted to pull the two into a firm holding position fastening the base assembly 11 and hopper 12 together. As shown on FIG. 3, the plural snap assemblies 13 are disposed about the periphery of the machine 10 so that they register with one another at one coaxial position of the hopper 12 on the base 11. For reasons as will be apparent hereinafter, the upper hopper 12 may be assembled in only one attitude on the base so as to always locate the cooperating parts of the two in the same manner and in their operating position.

Figure 2:
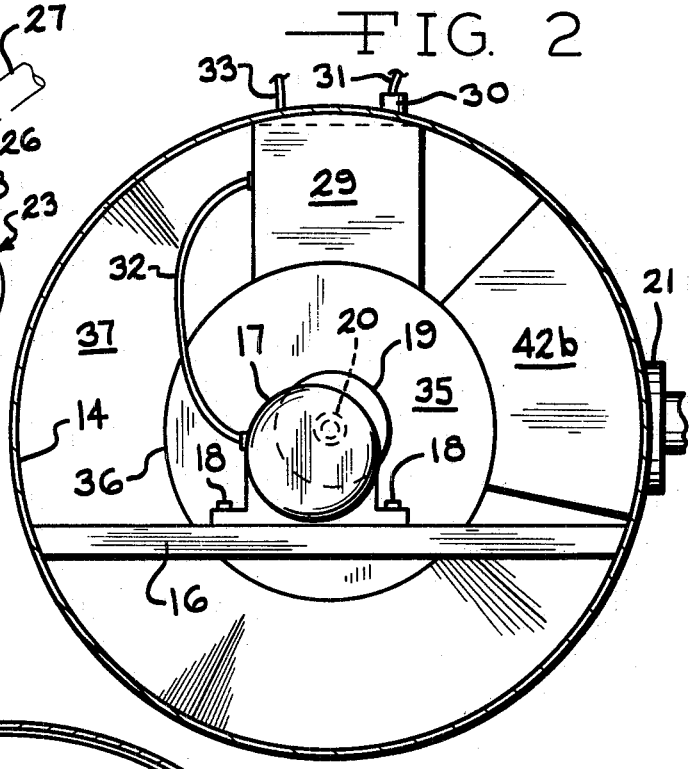
FIG. 2 is a sectional view taken along line 2—2 on FIG. 1.
Figure 4:
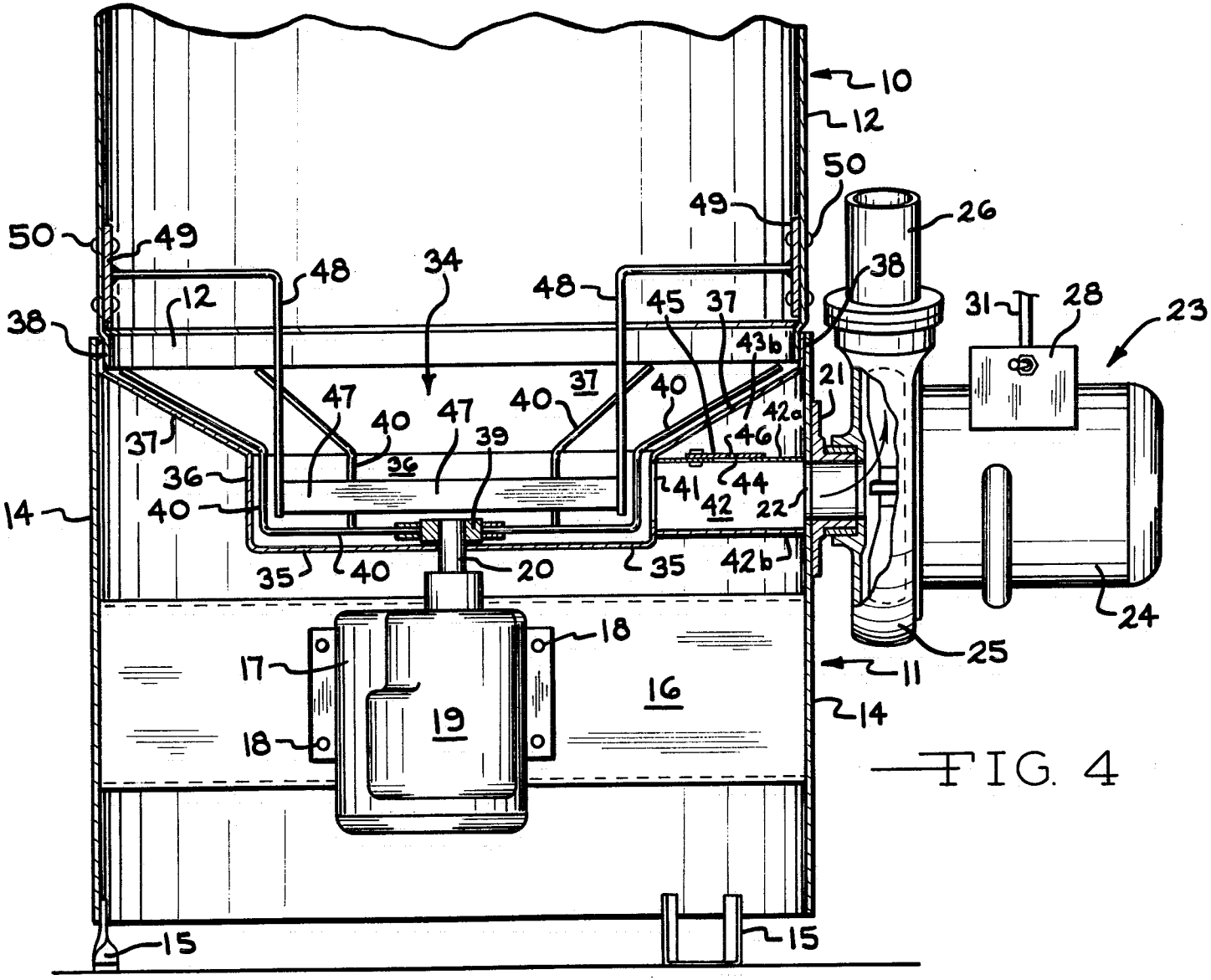
FIG. 4 is a fragmentary sectional view taken along line 4—4 on FIG. 3.

The base assembly 11 has a circular sidewall 14 and three feet 15 along the bottom edge of wall 14 to support the base above the floor and allow for introduction of air interiorly of the circular sidewall. As shown in FIGS. 2 and 4, a horizontal cross beam 16 is fastened at its ends to the interior of sidewall 14 and supports a motor assembly 17 fastened thereon by bolts 18. The motor assembly 17 comprises a fractional horsepower electric motor and a geared speed reduction unit 19 having a vertical output shaft 20. A coupling 21 is mounted on the sidewall 14 surrounding an opening 22 through sidewall 14 (see FIG. 4). The coupling 21 mounts a blower assembly 23, including a suitable drive motor 24 and a blower 25. The blower 25 includes a discharge pipe 26 which mounts a flexible conduit or hose 27 (phantom outline on FIG. 1) for dispensing the material to the work site.

Referring to FIG. 4, a control box 28 is mounted on the motor 24 of blower assembly 23 and is electrically connected to operate motor 24. Similarly, a control box 29 (FIG. 1) is provided on the sidewall 14 of the base 11 and operatively connected to control the operation of the motor 17 inside base 11. Control box 29 includes an electrical outlet 30 connecting it with control box 28 of the blower assembly through an electrical conduit 31 engaged with outlet 30. An electrical conduit 32 (FIG. 2) provides an electrical connection between control box 29 and motor 17. An electrical supply cord 33 is connectable to a line power source (not shown).

Figure 3:
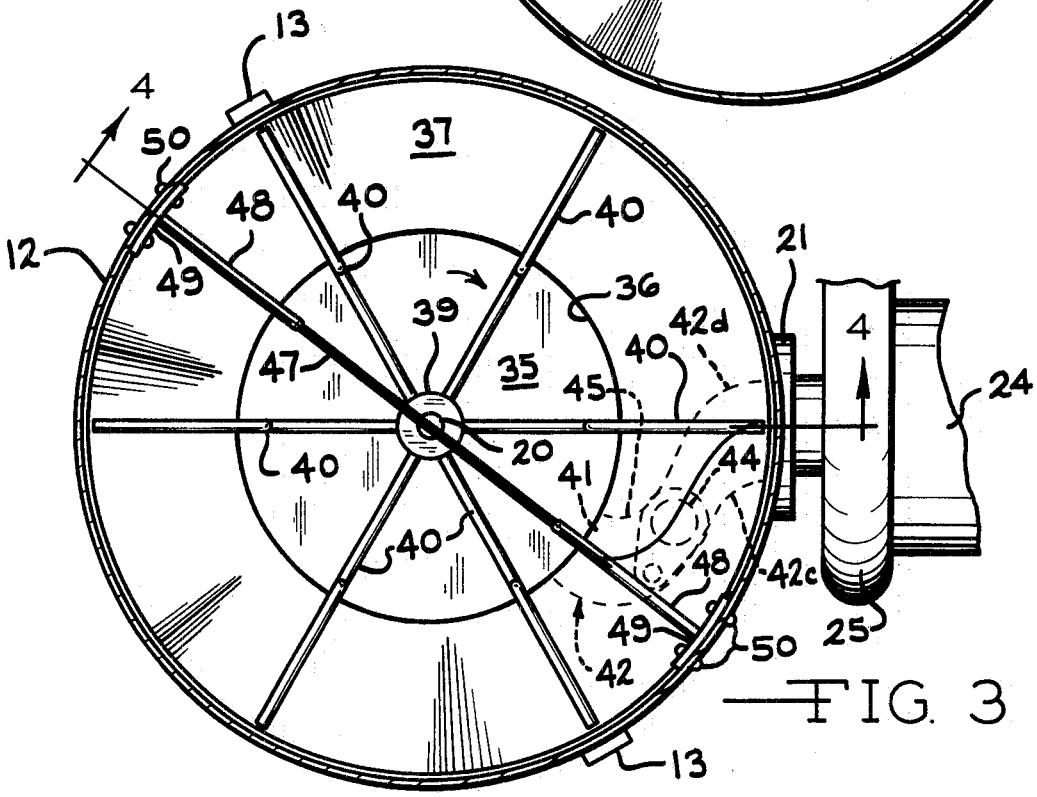
FIG. 3 is a sectional view taken along line 3—3 on FIG. 1.
Figure 5:
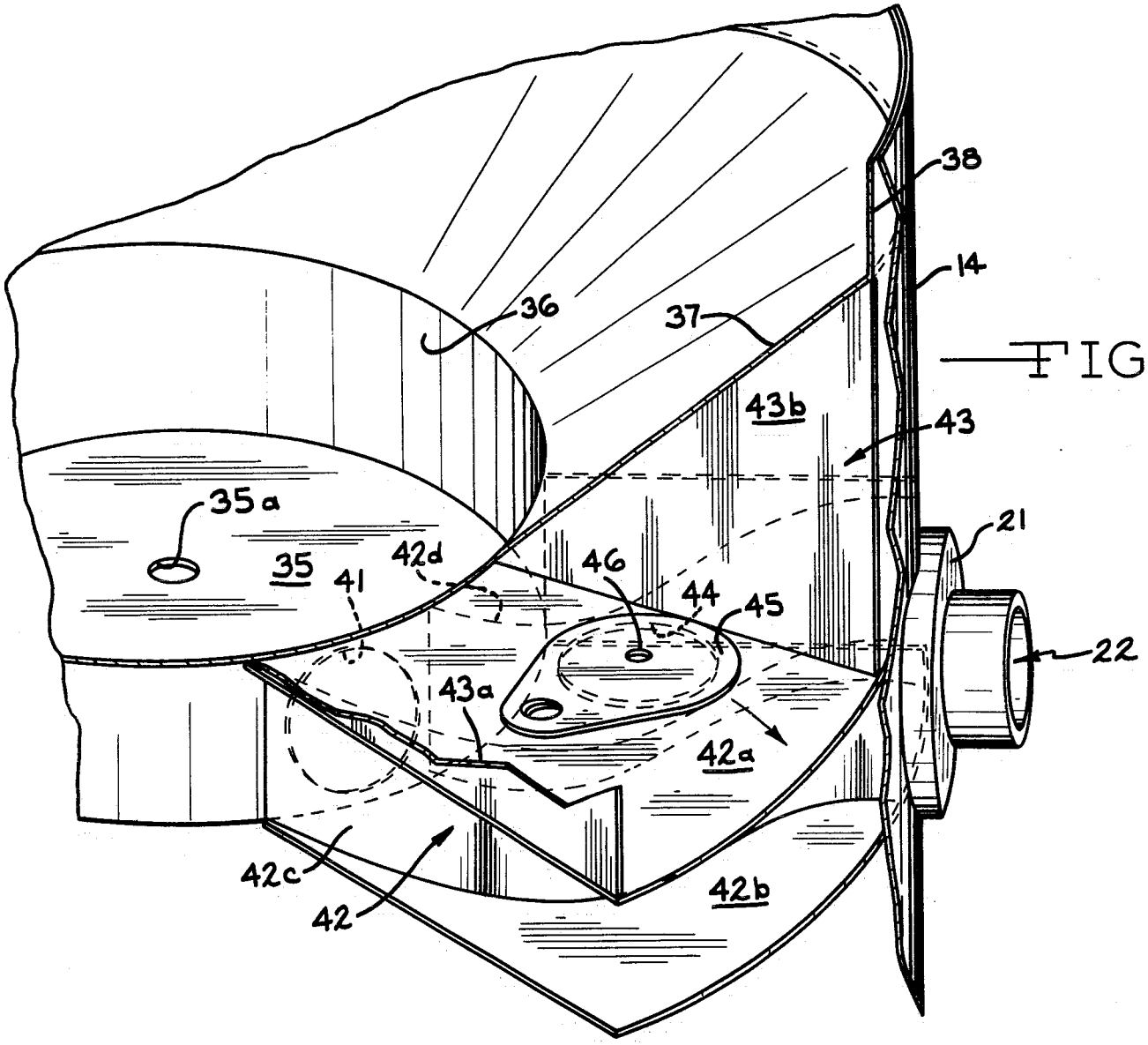
FIG. 5 is an enlarged perspective view with parts broken away, showing the interior detail of the material feed.

Referring to FIGS. 3–5, the base assembly 11 includes a stepped-down floor plate assembly 34 which is comprised of a lower circular, horizontal wall segmemnt 35, an intermediate annular, vertical wall segment 36, and an upper angled wall segment 37 that is sloped upwardly and outwardly towards the upper edge of the base circular sidewall 14. The floor plate assembly 34 may be formed as a drawn or cast article made of metal or plastic material, or may be formed into individual segments and fastened together such as by welding. The outer, upper perimeter of the upper angled wall segment 37 includes a turned-up, vertical extension 38, preferably as a circular web, which provides a means for suitably fastening the floor plate assembly 34 in place inside of the base sidewall 14 by conventional means, such as by welding.

The vertical output shaft 20 connected to motor 17 extends through an opening 35*a* (see FIG. 5) on the axial center of the circular horizontal segment 35 of floor plate assembly 34 by a short distance and receives an agitator hub 39 which is fastened on the shaft for rotation together. Hub 39 includes a shaped radial means comprising a plurality of arms 40 each contoured to correspond with the radial contour of the floor plate assembly 34. Arms 40, in the example shown on the drawings, are six in number and equally spaced about the hub 39.

Each of the arms 30 is made from steel rod bent to a contour such that they are approximately parallel with the contour of the floor plate assembly 34. The hub 39 is mounted on shaft 20 to space the arms 40 above floor plate assembly 34 a short distance, preferably in the range of one to two inches.

Referring to FIGS. 4 and 5, the floor plate assembly 34 includes a circular opening 41 in the vertical wall segment 36 at a location adjacent the blower assembly 23. The two openings 41 and 22 are connected by a duct housing 42 which includes spaced upper and lower plates 42*a* and 42*b*. The plates 42*a* and 42*b* are each attached to the vertical wall 36 and the sidewall 14, respectively, in combination with parallel S-shaped walls 42*c* and 42*d*, which together define a passageway between the discharge opening 41 in the floor plate and the inlet to the blower at opening 22. A recess 43 in the side of the base 11 is defined along its wall 14 overlying the duct housing 42. The recess 43 is defined by a portion of the exterior of the sloped segment 37 of the floor plate assembly, the upper plate 42*a* of the duct housing and spaced, radial, essentially triangular side plates 43*a* and 43*b*. The upper plate 42*a* is provided with an opening 44 for introducing atmospheric air into the interior of the duct housing 42. A valve plate 45 having a bleed opening 46 is pivoted on the top side of upper plate 42*a* over the opening 44. The valve plate 45 is moved manually to adjust the area of the opening 44 for atmospheric air regulation. The bleed opening 46 in the valve plate 45 insures that some atmospheric air is always introduced to the housing 42.

The upper hopper 12 is generally cylindrical and is removably attached to the top of base 11, as was indicated earlier herein, by the snap assemblies 13. An important feature of the machine of the present invention is an anti-spin bar 47 (FIGS. 3 and 4) which is comprised of a steel bar preferably of about $1 \times \frac{1}{8}$ inch section that is supported at its opposite ends on steel brackets 48 formed of bent rod. The brackets 48 extend generally vertically a distance above the elevation of the top of the base assembly 11 (when the hopper 12 is assembled and in operating position) and then at right angles radially outwardly to the wall of the hopper 12. The brackets 48 are welded to curved plates 49 which are riveted, as at 50, to the wall of the hopper 12 in a position for locating the anti-spin bar 47 diametrically in front of the opening 41 in the vertical wall segment 36 of the base floor plate assembly 34. As was mentioned earlier, the snap fasteners 13 are peripherally located on the hopper and base sidewalls, respectively, such that each time the hopper 12 is assembled onto base 11, it locates the proper attitude and orientation of the anti-spin bar 47. Such an arrangement of snap fasteners 13 is illustrated on FIG. 3. In the blowing of a cellulosic insulation material, it has been found that the anti-spin bar 47 should be positioned to provide approximately one to two inches of clearance between the lower edge of the bar 47 and the top of the horizontal reaches of arms 40, and clearance in the same range of spacing between the brackets 48 and the vertical reaches of the arms 40.

During the operation of the machine 10, cellulosic insulation material is placed in the open top end of the hopper 12 and the motor 17 is energized to rotate the agitator arms 40 at a slow rpm. The blower assembly 25 may then be turned on by energizing its motor 24. Insulation material drops onto the floor plate assembly 34 by gravity and within the reaches of agitator arms 40. The material is carried to the vertical opening 41 and the suction of the blower intake moves the material through the duct housing 42 and into the blower 25. Any tendency for the material to bridge, agglomerate or clog at discharge in opening 41 is reduced by the action of the agitator arms 40 moving past the stationary anti-spin bar 47.

In the construction of the machine described herein, the choice of materials is optional; however, it is preferable to construct the hopper 12 essentially of plastic, such as polyethylene, and construct the base susbstantially of metal. This type of construction provides a machine 10 that is readily portable and suitable for use by homeowners and contractors.

Having described the invention in some detail with respect to one preferred embodiment thereof, other and further modifications and variants of the invention will occur to those skilled in the art.

What I claim is:

1. An improved cellulosic insulation blowing machine having a base, an agitator assembly, motor means connected for driving said assembly including an output shaft, a blower assembly adjacent said base and an upper hopper removably mounted on said base characterized by having a stepped-down floor plate assembly on said base including interconnected segments comprising
an outer downwardly sloped wall,
a generally vertical, annular wall adjacent said sloped wall, and
an annular, generally horizontal floor adjacent said vertical wall, said floor plate assembly including a material opening therein and means connecting said opening with said blower assembly, said agitator assembly having at least one stepped radial arm extending from a central axis of the floor plate assembly to the proximity of the outer periphery thereof and having interconnected generally horizontal, generally vertical, and outwardly sloped segments which substantially parallel the crosssection of said stepped-down floor plate assembly, means connecting the inner end of said arm with the motor output shaft for rotation and supporting said radial arm in spaced relationship above said floor plate assembly, an anti-spin bar member, and means for supporting the anti-spin bar member above and stationary with respect to said floor plate assembly and positioned in closely spaced relation above the stepped radial arm in operating position, said anti-spin bar member being disposed inwardly of said arm adjacent said material opening in the floor plate assembly.

2. The machine improvement of claim 1, wherein said material opening is disposed along the annular vertical wall segment of the floor plate assembly, said anti-spin bar member being supported on the upper hopper and positioned thereby in its operating position diametrically above the annular horizontal segment of the floor plate assembly.

3. The machine improvement of claim 1, wherein the material opening is disposed in the annular vertical wall segment of said floor plate assembly.

4. The machine improvement of claim 1, in which the anti-spin bar member support means includes brackets rigidly connected to the upper hopper, said hopper being mounted on the base in an aligned operating position.

5. The machine improvement of claim 1, in which said connecting means include a hub and said agitator assembly comprises a plurality of said stepped radial arms supported on said hub and spaced a short distance from the floor plate assembly, said hub being connected to the motor output shaft.

6. The machine improvement of claim 5, in which there are six stepped radial arms on said hub.

7. The machine improvement of claim 6, which includes means locating the upper hopper assembly on the base assembly correspondingly with the operating position of the anti-spin member supported thereon, said means operatively connecting said hopper and said base.

8. The machine improvement of claim 7, wherein said means operatively connecting said hopper and said base comprises peripherally spaced snap assemblies.

9. A material feed assembly for use with a cellulosic insulation blowing machine or the like having a base assembly, a blower assembly connected thereto and an upper hopper assembly removably mounted on said base assembly, said material feed assembly comprising a floor plate assembly including an outer, annular, generally vertical wall, and an interconnected central generally horizontal wall adjacent a lower portion of said vertical wall, a material feed opening in said vertical wall adapted for connection with said blower assembly, an agitator assembly having rotatable, shaped radial means supported centrally of said floor plate assembly and in spaced overlying relationship thereto, said radial means being contoured correspondingly to the cross-section of said floor plate assembly and generally parallel thereto in operating position, and an anti-spin bar member in overlying and inwardly spaced relationship with said radial means of the agitator assembly, said anti-spin member when in its operating position being stationary with respect to said radial means, and adjacent said material feed opening of the floor plate assembly.

10. The material feed assembly of claim 9, wherein said anti-spin bar member is aligned with such material feed opening of said floor plate assembly.

11. The material feed assembly of claim 10, wherein said base defines an "S-shaped" duct housing between said material feed opening and said blower assembly.

12. The material feed assembly of claim 11, wherein said radial means rotate in a first direction and said "S-shaped" duct housing extends from said material feed opening in a direction counter to said first direction.

13. The material feed assembly of claim 9, in which said radial means comprise plural radial arms supported by a central hub, said arms being spaced about the periphery of said hub.

14. The material feed assembly of claim 13, characterized by the floor plate assembly also having an annular upwardly and outwardly sloped wall encircling the said vertical wall and connected therewith along its upper perimeter edge, said radial arms each being contoured correspondingly to the cross section of said floor plate assembly including the upwardly and outwardly sloped wall portion thereof.

* * * * *